US005243385A

United States Patent [19]

Thayer

[11] Patent Number: 5,243,385

[45] Date of Patent: Sep. 7, 1993

[54] BOWED SUPPORT FOR BELT PHOTORECEPTOR TO EQUALIZE BLADE CLEANING CONTACT PRESSURE

[75] Inventor: Bruce E. Thayer, Webster, N.Y.

[73] Assignee: Xerox Corporation, Stamford, Conn.

[21] Appl. No.: 920,714

[22] Filed: Jul. 28, 1992

[51] Int. Cl.[5] ..... G03G 5/00

[52] U.S. Cl. ..... 355/212; 355/299

[58] Field of Search ..... 474/92, 111, 134; 355/212, 213, 296, 299

[56] References Cited

U.S. PATENT DOCUMENTS

| | | | |
|---|---|---|---|
| 3,984,183 | 10/1976 | Maksymiak | 355/212 X |
| 4,499,849 | 2/1985 | Tomita et al. | 355/296 X |
| 4,630,920 | 12/1986 | Silverberg et al. | 355/299 |
| 4,690,544 | 9/1987 | Forbes, II et al. | 355/299 |
| 4,812,878 | 3/1989 | Kaieda | 355/299 |

FOREIGN PATENT DOCUMENTS

| | | | |
|---|---|---|---|
| 0073178 | 4/1986 | Japan | 355/299 |
| 2206535 | 1/1989 | United Kingdom | 355/213 |

OTHER PUBLICATIONS

Thayer et al.; EPA #322,229; Jun. 1989.

*Primary Examiner*—A. T. Grimley
*Assistant Examiner*—Robert Beatty
*Attorney, Agent, or Firm*—Oliff & Berridge

[57] ABSTRACT

Apparatus for increasing the cleaning efficiency of rigid blade cleaners used to clean compliant belt-type photoreceptors in low to high volume, black and white and color electrophotographic copiers and printers. A center portion of a backing photoreceptor support roll is proportionately bowed outward toward the cleaning blade to compensate for nonuniform belt tension under the blade cleaner due to the deflection of the backing support roll. In particular, the appropriate amount of bow in the center portion of a backing photoreceptor support roll or, alternatively, channel backer, results in a uniform cleaning blade load and, therefore, enhanced cleaning across a compliant belt photoreceptor having non-uniform belt tension, that is inexpensive and easy to manufacture and implement.

16 Claims, 6 Drawing Sheets

BOWED SUPPORT FOR BELT PHOTORECEPTOR TO EQUALIZE BLADE CLEANING CONTACT PRESSURE

BACKGROUND OF THE INVENTION

1. Field of the Invention

This invention relates to electrophotographic image forming apparatus, and more particularly to cleaning devices for removing residual toner and debris from a charge retentive surface of an image forming apparatus.

2. Description of Related Art

In electrophotographic applications such as xerography, a charge retentive surface of a photoreceptor is electrostatically charged, and exposed to a light pattern of an original image to be reproduced, to selectively discharge the photoreceptive surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as toner. Toner is held on the image areas by the electrostatic charge on the surface. Thus, a toner image is produced in conformity with a light image of the original beam reproduced. The toner image may then be transferred to a substrate (e.g., paper), and an image affixed thereto to form a permanent record of the image to be reproduced. The process is well known, and is useful for light lens copying from an original, and printing applications from electronically generated or stored originals, where a charge surface may be discharged in a variety of ways. Ion projection devices where charge is imagewise deposited on a charge retentive substrate operates similarly.

Multi-colored electrophotographic printing is substantially identical to the foregoing process of black and white printing. However, rather than forming a single latent image on a photoreceptor, successive latent images corresponding to different colors are recorded thereon. Each single color electrostatic latent image is developed with toner of a color complementary thereto. This process is repeated in a plurality of cycles for different colored images and their respective complementary colored toner.

Each single colored toner image is transferred to the copy sheet in superimposed registration with the prior toner image. This creates a multi-layered toner image on a copy sheet. Thereafter, the multi-layered toner image is permanently affixed to the copy sheet as described above to create a color copy. The developer material (toner) may be a liquid material or powder material.

Although, a preponderance of the toner forming the image is transferred to the paper during transfer, some toner invariably remains on the charge retentive surface of the photoreceptor, it being held thereto by relatively high electrostatic and/or mechanical forces. Additionally, paper fibers, toner additives, kaolins and other debris have a tendency to be attracted to the charge retentive surface. It is essential for optimal imaging that the toner and debris remaining on the surface be cleaned thoroughly therefrom.

The quality of images produced by such equipment depends significantly on the ability to clean the photoconductive surface before it is reused.

Blade cleaning is a highly desirable method for removal of residual toner and debris (hereinafter, collectively referred to as "toner") from a photoreceptor. In a typical application, a relatively thin elastomeric blade member is provided and supported rigidly or in an extended manner adjacent to and transversely across the photoreceptor surface with the blade edge chiseling (doctor mode) or wiping (wiper mode) toner from the surface. Subsequent to release of toner to the surface, the released toner accumulating adjacent to the blade is transported away from the blade area by a toner transport arrangement, or by gravity.

The design and development of a photoreceptor cleaner using an elastomeric blade can be simplified by the use of a rigid blade holder. This blade holder supports the blade down to its tip by eliminating the extension of the blade from the holder. An advantage of this type of holder is that the blade material can be specified such that the tip properties can be optimized for cleaning without the need for concern about the beam properties which are needed to support a conventional blade using an extension. The rigid holder also has the advantage of expanding the blade cleaning operating range for loads and blade tip angles. Because no appreciable deflection of the blade occurs, the blade tip angle can be set to within manufacturing and assembly tolerances (known in the art and peculiar to each machine), while the blade load can be set to any desired value independently of the blade tip angle. This flexibility allows combinations of tip angles and blade loads to be used which are not possible with a single extended blade cleaner. In order to achieve the desired flexibility without using a rigid holder, changes in the blade stiffness would be required either in thickness, material or extension length.

Of course, it is further understood by one skilled in the art, that use of a rigid blade holder cleaner is most effective in concert with a compliant belt photoreceptor, in order to ensure proper cleaning of the imaging surface. This is because the rigid blade and rigid photoreceptor interface could never be straight enough or aligned well enough in production to ensure either adequate contact or minimum cleaning pressure along the full length of the blade. A belt photoreceptor, therefore, supplies sufficient compliance for the photoreceptor to conform to the variations in the rigid blade in much the same way that the extended blade supplies the compliance to conform to a rigid drum photoreceptor.

During testing, however, when rigid blade holder cleaners were tested on machines with compliant belt photoreceptors, poor cleaning was observed in the center region of the blade. Initial inspection indicated that the two support rolls nearest the cleaning blade were straight and aligned well with the blade. Upon further inspection, however, it was discovered that the belt tension across the belt was non-uniform and low in the center. The lower non-uniform belt tension across the flat photoreceptor caused the cleaning load on the blade to be below the minimum acceptable cleaning load in the center of the blade. Additionally, it was further determined that the lower belt tension was caused by deflection of the adjacent support rolls which, though slight, was enough to cause the sag in belt tension in the center of the belt and thus the poor cleaning results.

Accordingly, a need exists for an apparatus to eliminate the non-uniform belt tension under rigid blade cleaners due to photoreceptor support roll deflection. This may be achieved by uniformly increasing the diameter of the Low Lateral Force (LLF) photoreceptor support rolls, however, this adds significant cost to the rolls and, therefore, the cost of the machine. Additionally, as known in the art, smaller rolls have routinely been used to improve the copier's paper stripping capability after transfer. The smaller the shaft (at the center of the LLF roll), the more diameter is available for longer rubber LLF petals. As the petals become shorter, they become stiffer and must be made thinner to compensate. Thinner petals result in more cuts and a higher rejection rate thus, higher cost.

SUMMARY OF THE INVENTION

It is thus an object of the invention to obviate the foregoing drawbacks of the prior art by providing an efficient apparatus for improving cleaning efficiency of blade cleaners used for removing residual toner and debris from the charge retentive surface of a moving photoreceptor.

Another object of the invention is to provide a bowed or crowned support roll for a belt photoreceptor adjacent to and across from a cleaning blade in order to equalize blade cleaning contact pressure thereby improving cleaning performance.

Still another object of the invention is to substitute a channel backer for a support roll adjacent to and across from a cleaning blade to bow the belt photoreceptor and equalize blade cleaning contact pressure thereby improving cleaning performance.

These and other objects and advantages are obtained by the inventive apparatus for improving cleaning efficiency of blade cleaners used for cleaning a charge retentive surface of a moving belt photoreceptor which comprises a blade holder pivotally attached to end plates of the cleaning apparatus which has at least one elastomeric cleaning blade mounted thereon, a belt photoreceptor moving over and supported by a plurality of support rolls, where a backing support roll, disposed adjacent to and opposite the cleaning blade, is bowed towards the blade in a center portion to compensate for inherent non-uniform belt tension due to support roll deflection. Alternatively, the backing support roll may be replaced by a U-shaped channel backer to similarly achieve the described bowing effect. Finally, the channel backer may incorporate a channel stiffener bar to further limit backer deflection caused by belt and belt drive tension.

Other objects, advantages and salient features of the invention will become apparent from the detailed description, which taken in conjunction with the annexed drawings, discloses preferred embodiments of the invention.

BRIEF DESCRIPTION OF THE DRAWINGS

Referring now to the drawings which form part of this original disclosure.

DETAILED DESCRIPTION OF THE PREFERRED EMBODIMENTS

Figure 1:
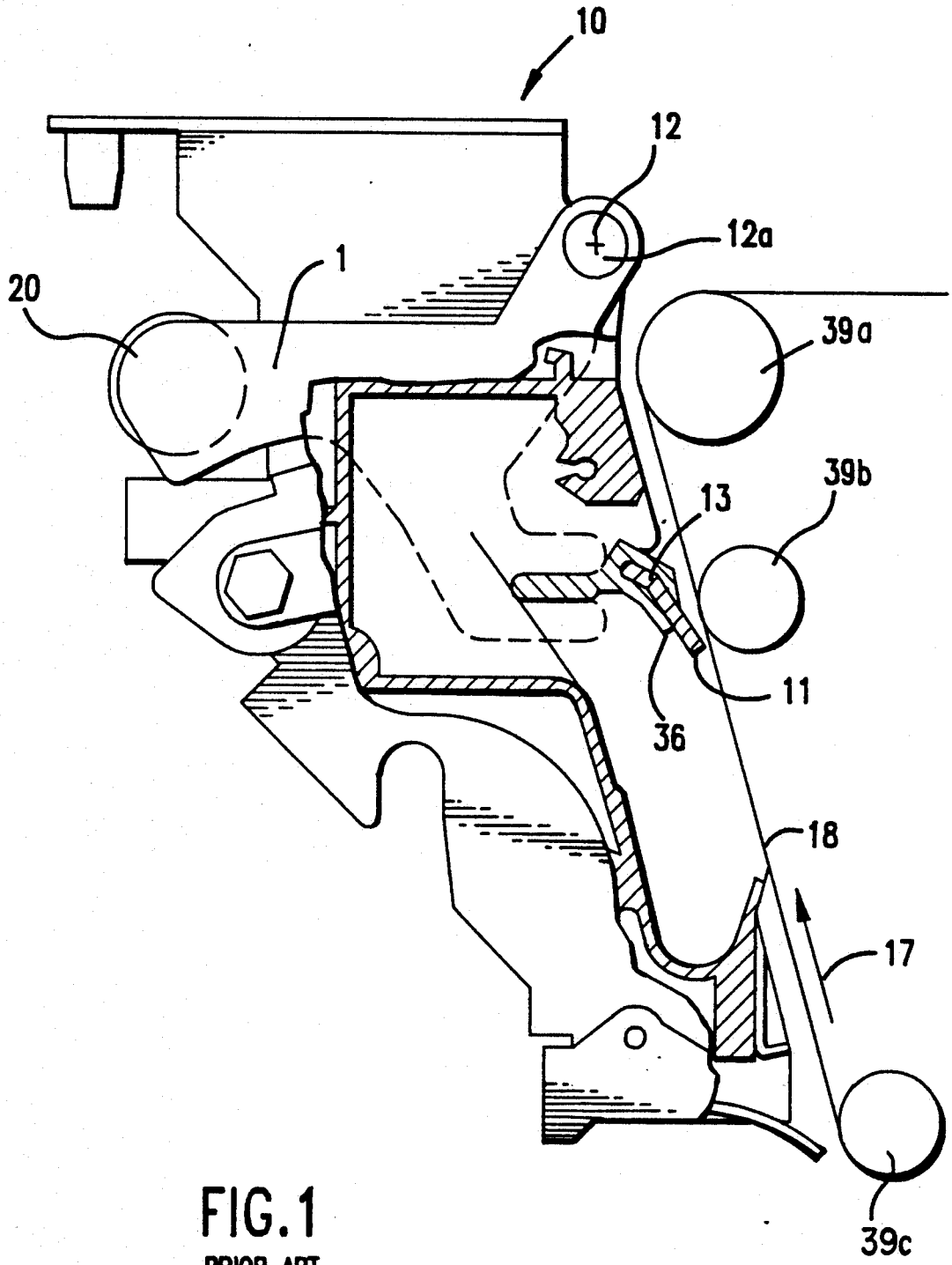
FIG. 1 PRIOR ART
FIG. 1 is a schematic, partially cut away plan view of a prior art cleaning assembly incorporating an extended blade holder and a photoreceptor backer roll.

The apparatus for improving the cleaning efficiency of blade cleaners used for cleaning a charge retentive surface of a moving photoreceptor will be described in combination with a particular copier or xerographic device that uses a compliant belt photoreceptor having a charge retentive surface. However, the cleaning apparatus of the present invention may be used with any printing apparatus that includes a belt-type charge retentive surface, including multiple or single color printers. The present invention is particularly applicable to any printer containing a belt-type charge retentive surface which is subject to the retention of toner particles thereon.

For a general understanding of the features of the present invention, reference is made to the drawings. In the drawings, like reference numerals have been used throughout to designate identical elements.

Turning now to FIG. 1, the photoreceptor cleaning apparatus 10 of a prior art device is shown. The blade holder support assembly 1 supports a single blade (an extended blade holder 36 and doctor blade 13 is shown) and is pivotally attached to the cleaning apparatus at a pivot point 12*a*. The blade holder support assembly is free to pivot independently about the pivot axis 12, thus enabling the cleaning blade edge 11 to optimally align itself with the photoreceptor surface 18. The photoreceptor direction of movement is indicated by arrow 17. Also attached to the blade holder support assembly 1 is a blade load weight 20. This weight 20 transfers a force through the support means 1 to supply the cleaning blade 13 load. Therefore, the pivotable support assembly 1, with weight 20, enables the cleaning blade edge 11 to achieve the correct blade load and alignment angle to optimally clean the photoreceptor surface 18. The compliant belt photoreceptor 18 moves over and is supported by support rolls 39, with the drive roll indicated at 39*a* and a direction changing roll indicated at 39*c*. A backer roll 39*b*, disposed adjacent to and opposite the cleaning blade edge 11, is actually a substantially rigid rotatably mounted tube.

Of greatest interest to effective photoreceptor cleaning, are the parameters of cleaning blade and photoreceptor belt stiffness. Blade 13 stiffness is a function of blade material, blade extension and blade thickness. Photoreceptor belt 18 stiffness is primarily a function of support roll 39 spacing, resistance to deflection and belt tension.

Testing has shown, that the uniformity of blade load across the photoreceptor surface 18 to be cleaned depends upon the uniformity of belt stiffness under the blade. Data indicates that a typical belt is stiffer at the inboard and outboard edges and softest in the center region (not shown). Assuming a rigid blade holder assembly 15 (see FIG. 2) for example, with uniform load application and blade stiffness, higher blade loads must be applied at the inboard and outboard regions of the photoreceptor belt to provide the center region with enough load to adequately clean. A rigid blade holder assembly 15, having a rigid blade holder 16 and an elastomeric cleaning blade 13 with blade edge 11, has the highest non-uniformity of blade load against a non-uniform belt photoreceptor. Softer blades conform to the photoreceptor belt better, exhibiting smaller amounts of non-uniformity.

To eliminate the non-uniform belt tension under rigidly held blade cleaners 15 due to deflected support rolls 39, the photoreceptor supports can be bowed toward the cleaning blade in the center. This bow or crown 37 (see FIG. 2) machined or fixedly attached to a backing support roll **39*b* serves to compensate for the decreased belt stiffness at the center of the belt by increasing deflection of the center of belt 18 toward the rigid blade assembly 15. With an appropriate amount of bow resultant from the addition of a crown 37 portion to the backing photoreceptor support roll 39*b*, a uniform blade load and, therefore, uniform cleaning can be obtained across a belt photoreceptor 18** otherwise having non-uniform belt tension.

Testing to determine the proper amount of bow to be applied to the backing photoreceptor support roll **39*b* indicates that with straight (unbowed) support, cleaning fails first in the center of the belt as load on the rigid cleaning blade assembly 15 is reduced. The amount of bow can be increased until the first cleaning failures are observed uniformly across the belt 18**. By increasing the bow beyond this point, cleaning failures will occur first at the edges of the belt because the blade is now being supported by the center portion of the belt. In this case, for the copier machine used in testing, the optimal backer bow radius was determined to be between 100 and 300 feet. Further, although various blade angles were tested, blade angles of 10° and 20° demonstrated the best performance.

In addition to minimizing the total load required to clean across a full blade width, the uniform loading enabled by the crowned 37 backing photoreceptor support roll **39*b* can increase blade life. Blade wear studies indicate that the blade loading profile will be proportional to the belt stiffness curve and that blades will have wear failures at the ends, rather than across the entire blade, without the use of the crowned 37 backing photoreceptor support roll 39*b* or a channel backer 14**.

Figure 2A:
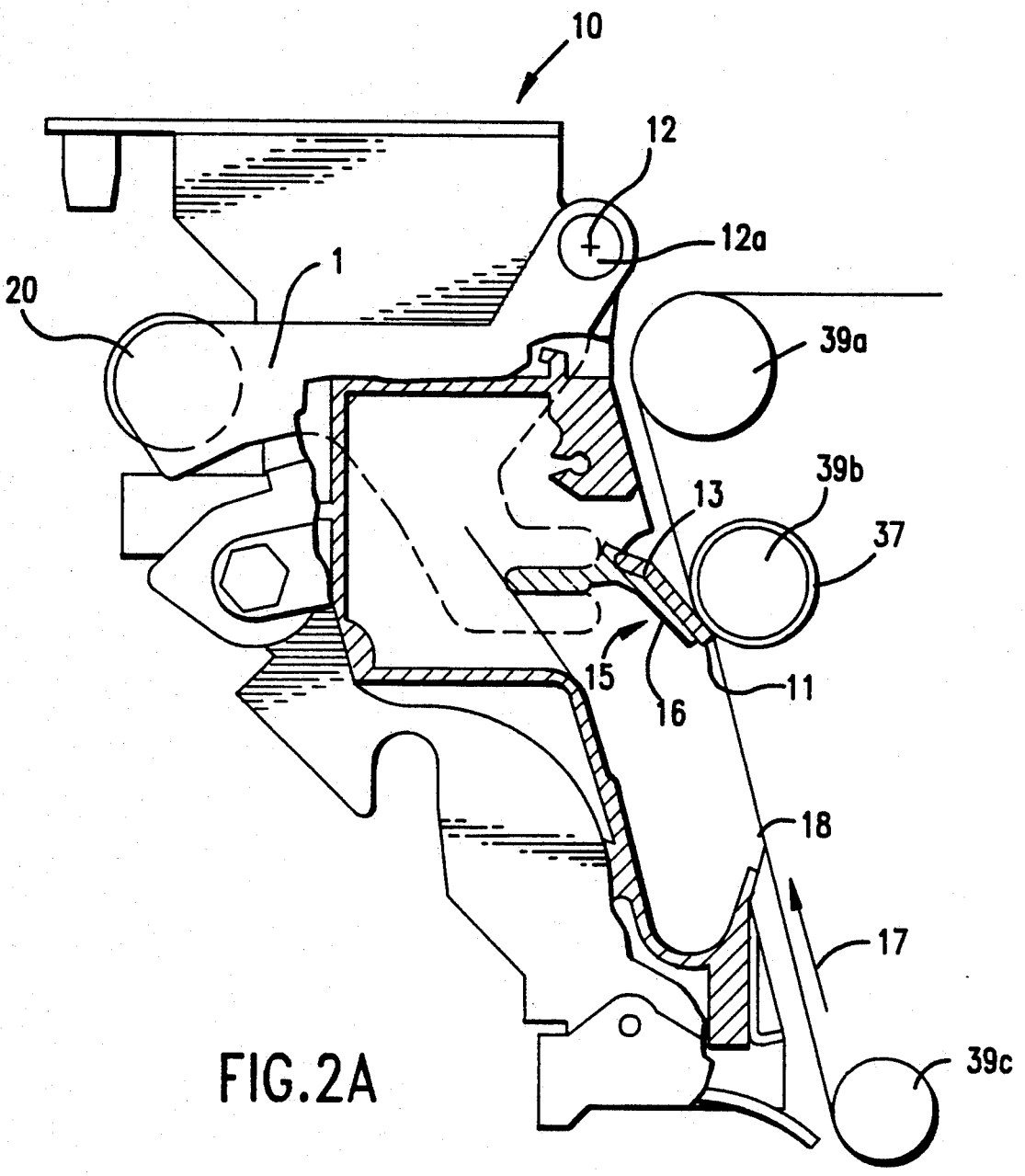
FIG. 2A is a schematic, partially cut away plan view depicting an embodiment of the invention.
Figure 2B:
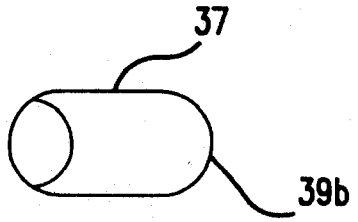
FIG. 2B is a schematic perspective view of the photoreceptor support roll with crown portion.

A first embodiment is seen in FIGS. 2A and 2B, wherein a backer roll **39*b* incorporating the above discussed crown portion 37 is positioned to bow the photoreceptor 18 center portion toward the rigid blade assembly 15. The crown portion 37** may be easily produced on a lathe. Support configurations other than a roll such as a ground bar (not shown), stamped sheet metal (not shown) or molded plastic (not shown) are possible, but may be less easily manufactured.

Figure 3A:
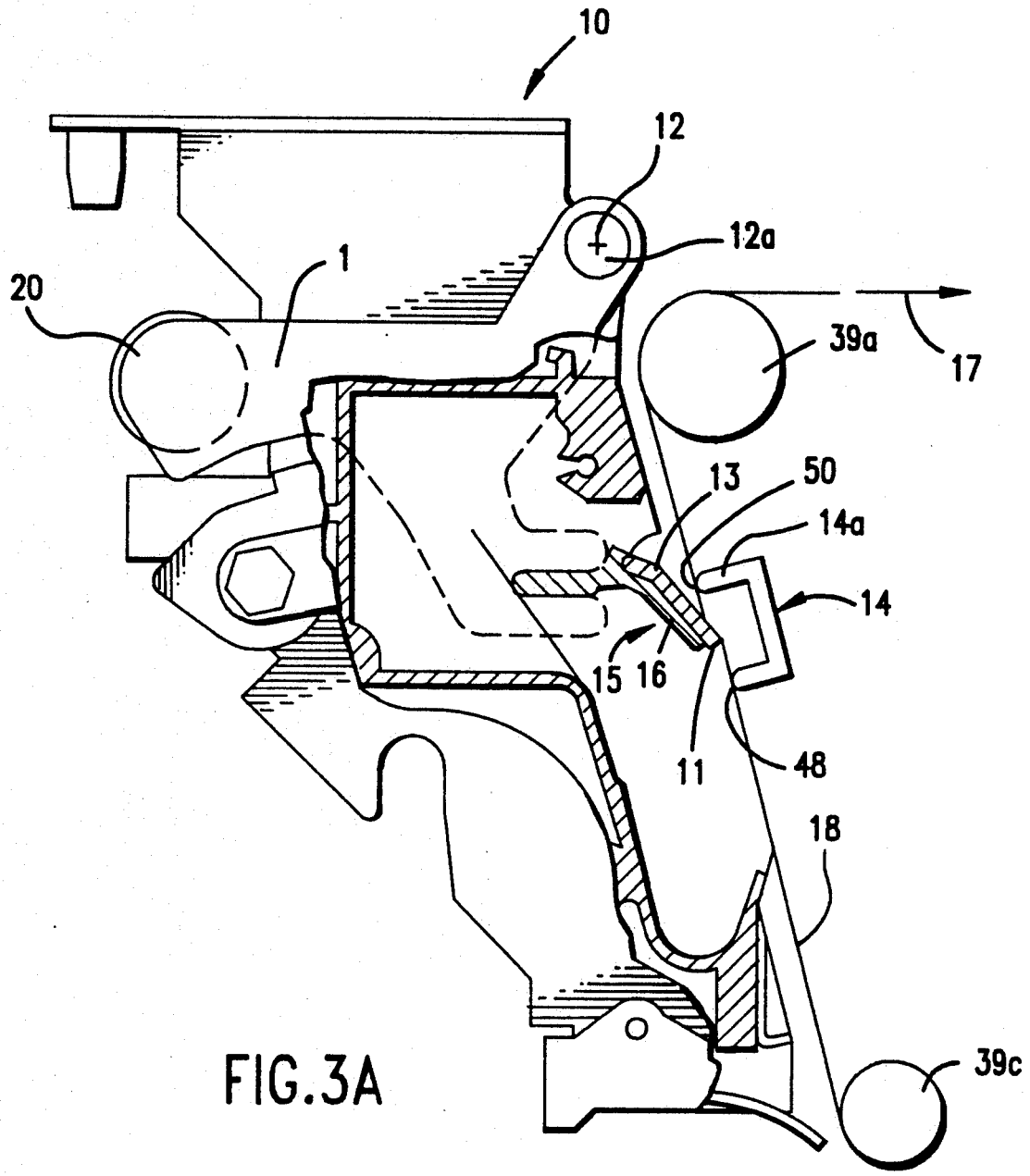
FIG. 3A is a schematic, partially cut away plan view depicting an alternative embodiment of the invention.
Figure 3B:
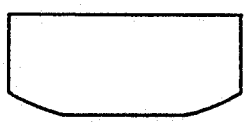
FIG. 3B is a schematic top view of the U-shaped channel backer.

Alternatively, a U-shaped channel backer 14 may replace the crowned 37 backer roll **39*b* described above FIGS. 3A and 3B to achieve the same bowing effect. The channel backer 14 is positioned such that the U-arms 14*a* are respectively disposed on the upstream 48 and downstream 50 sides of the rigid blade assembly 15 and behind the center portion of the photoreceptor 18, thereby bowing the photoreceptor center portion toward the cleaning blade assembly 15 as the photoreceptor 18 moves past the rigid blade assembly 15. As stated, this method was found to be equally successful at equalizing blade cleaning contact pressure and achieving improved blade cleaning performance for belt-type photoreceptors. The channel backer 14** may be made of extruded aluminum, sheet steel or other similar material.

Figure 4:
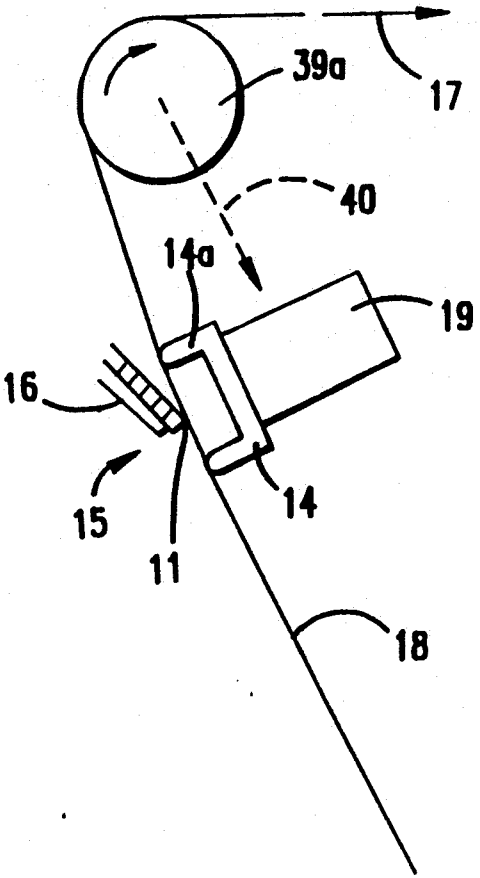
FIG. 4 is a schematic view depicting still another embodiment of the invention.

In a further embodiment, as seen in FIG. 4, a channel stiffener bar 19 may be attached to the U-shaped channel backer 14 described above. The bar 19 is provided to strengthen the channel backer 14 by providing additional resistance to belt drive roll **39*a* induced deflection. Also shown, in FIG. 4, is the resultant direction 40 of drive roll 39*a* deflection. Again, addition of the stiffener bar 19 serves only to assist the channel backer 14 described above in providing optimal bowing of the center portion of the belt photoreceptor 18 against the blade assembly 15** to ensure proper cleaning of the whole belt.

Figure 7:
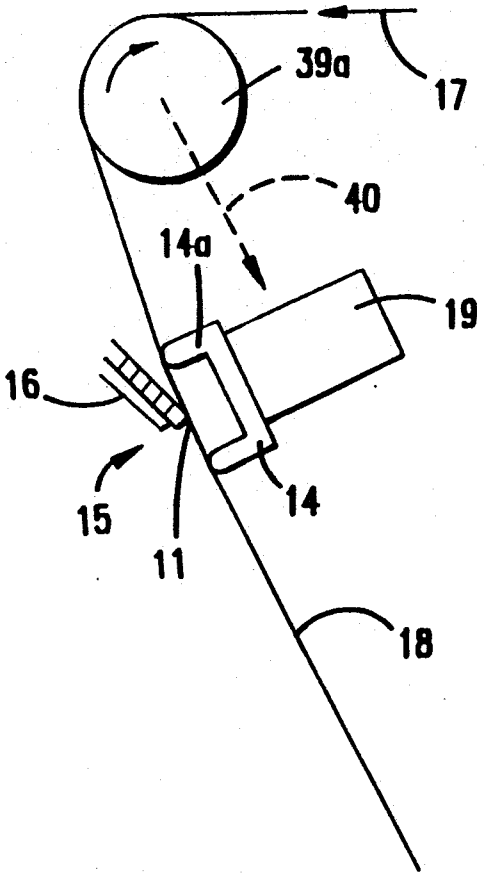
FIG. 7 is the schematic view of FIG. 4 with the blade edge operating in the wiper mode.
Figure 5:
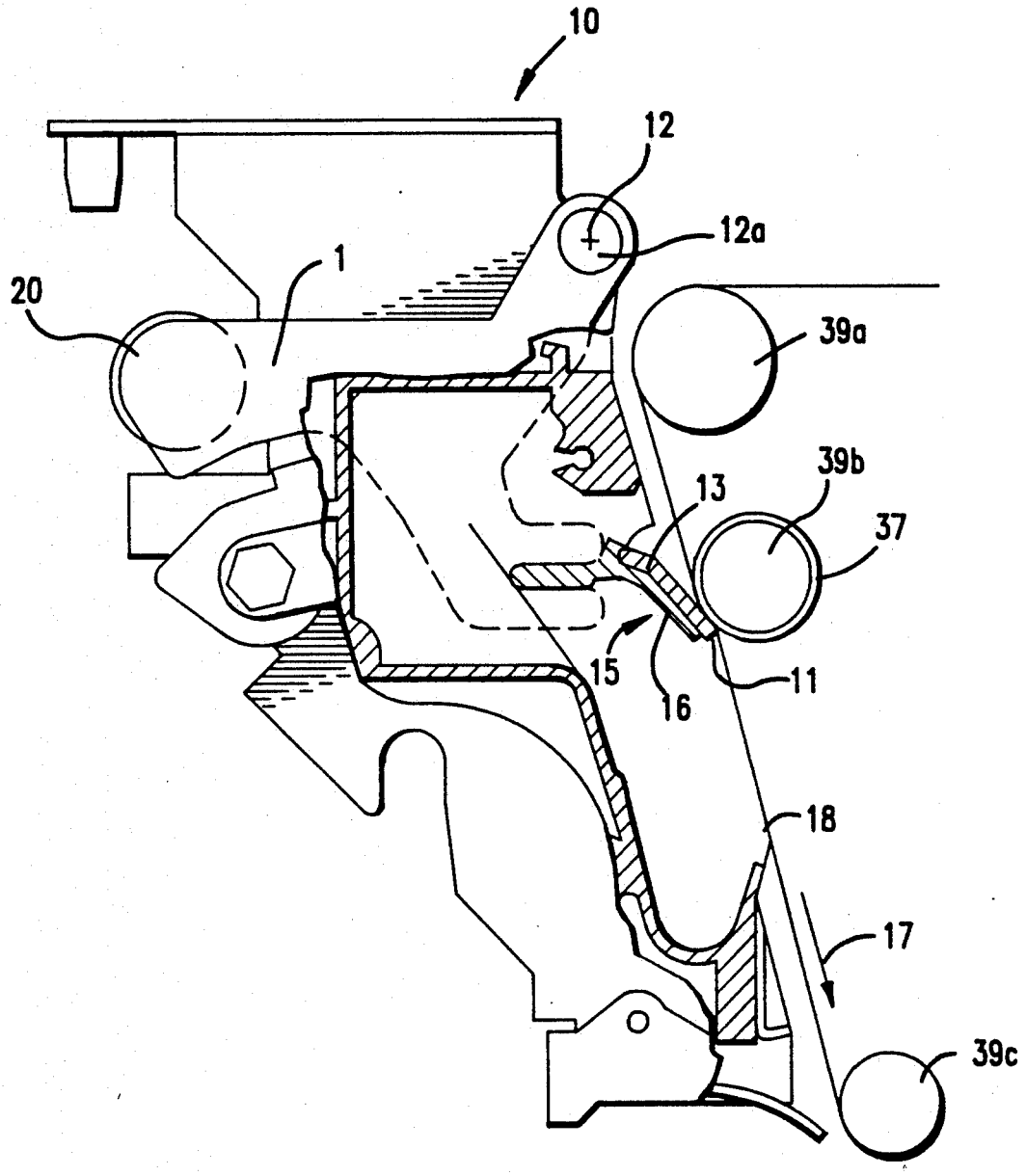
FIG. 5 is the schematic, partially cut away plan view of FIG. 2 with the blade edge operating in the wiper mode (i.e., the photoreceptor direction of movement is reversed)
Figure 6:
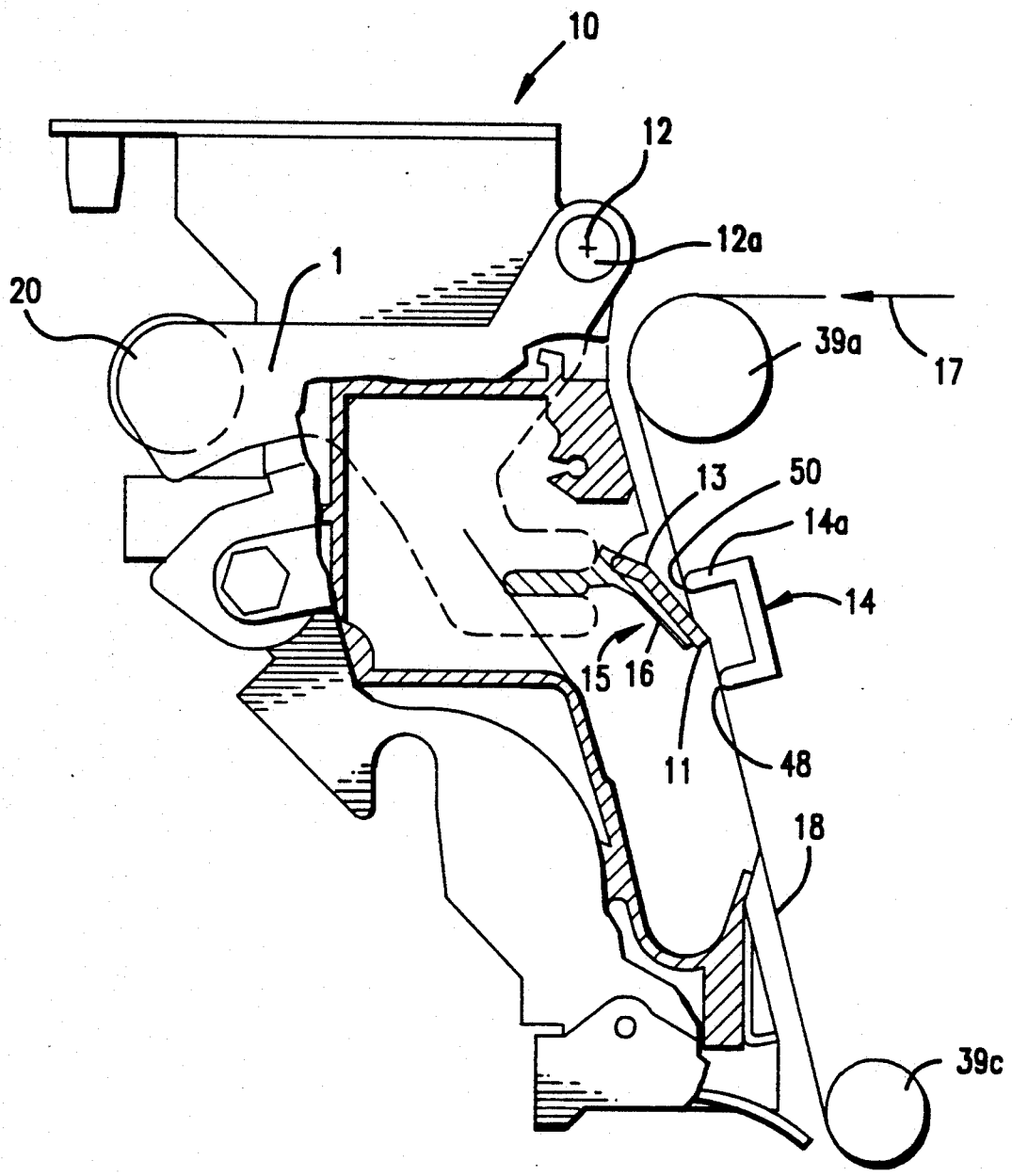
FIG. 6 is the schematic, partially cut away plan view of FIG. 3 with the blade edge operating in the wiper mode.

FIGS. 5–7 show examples of the above-described preferred embodiments wherein the cleaning blade edge 11 is operating in wiper mode, i.e., the photoreceptor 18 direction of movement 17 is reversed.

While the present invention has been described in connection with the preferred embodiments, it will be understood that it is not intended to limit the invention to these embodiments. On the contrary, it is intended to cover all alternatives, modifications and equivalents as may be included within the spirit and scope of the invention as defined by the appended claims.

What is claimed is:

1. An apparatus for cleaning a charge retentive surface of a moving belt-type photoreceptor, rotating in a feeding direction and supported by a plurality of support rolls, the charge retentive surface having particles thereon, comprising:

a rigid blade holder support assembly pivotally attached to end plates of the cleaning apparatus to support a cleaning blade adjacent its tip, further comprising at least one elastomeric cleaning blade mounted in said rigid blade holder which extends across and contacts the charge retentive surface;

a backing support, disposed adjacent to and opposite said cleaning blade, is bowed into a center portion of the belt-type photoreceptor and toward said blade.

2. The apparatus of claim 1, wherein said elastomeric blade is a doctor blade.

3. The apparatus of claim 1, wherein said elastomeric blade is a wiper blade.

4. The apparatus of claim 1, wherein said bowed backing support defines an arc having a radius of curvature in the range of 100–300 feet.

5. An apparatus for cleaning a charge retentive surface of a moving belt-type photoreceptor, rotating in a feeding direction and supported by a plurality of support rolls, the charge retentive surface having particles thereon, comprising:

a rigid blade holder support assembly pivotally attached to end plates of the cleaning apparatus to support a cleaning blade adjacent its tip, further comprising at least one elastomeric cleaning blade mounted in said rigid blade holder which extends across and contacts the charge retentive surface;

a backing support, disposed adjacent to and opposite said cleaning blade, is bowed into a center portion of the belt-type photoreceptor and toward said blade, wherein said backing support is a roll having a crown portion fixedly attached to said roll to provide said bow.

6. The apparatus of claim 5, wherein said elastomeric blade is a doctor blade.

7. The apparatus of claim 5, wherein said elastomeric blade is a wiper blade.

8. An apparatus for cleaning a charge retentive surface of a moving belt-type photoreceptor, rotating in a feeding direction and supported by a plurality of support rolls, the charge retentive surface having particles thereon, comprising:

a rigid blade holder support assembly pivotally attached to end plates of the cleaning apparatus to support a cleaning blade adjacent its tip, further comprising at least one elastomeric cleaning blade mounted in said rigid blade holder which extends across and contacts the charge retentive surface;

a backing support, disposed adjacent to and opposite said cleaning blade, is bowed toward said blade, wherein said backing support is a U-shaped photoreceptor channel backer, bowed into a center portion of the belt-type photoreceptor and disposed adjacent to and opposite said cleaning blade with U-arms of said channel backer being respectively disposed upstream and down-stream of said cleaning blade, and said channel backer further comprising a channel stiffener bar fixedly attached to said channel backer to prevent backer deflection.

9. The apparatus of claim 8, wherein said elastomeric blade is a doctor blade.

10. The apparatus of claim 8, wherein said elastomeric blade is a wiper blade.

11. An apparatus for cleaning a charge retentive surface of a moving belt-type photoreceptor, rotating in a feeding direction and supported by a plurality of support rolls, the charge retentive surface having particles thereon, comprising:

a rigid blade holder support assembly pivotally attached to end plates of a cleaning apparatus to support a cleaning blade adjacent its tip, further comprising at least one elastomeric cleaning blade mounted in said rigid blade holder;

a backing support, disposed adjacent to and opposite said cleaning blade, is bowed into a center portion of the belt-type photoreceptor and toward said blade; and wherein said cleaning blade extends across and contacts the charge retentive surface, said cleaning blade being biased against the charge retentive surface for scraping and removing the particles from the charge retentive surface as the charge retentive surface moves by said cleaning blade.

12. The apparatus of claim 11, wherein said elastomeric blade is a doctor blade.

13. The apparatus of claim 11, wherein said backing support is a roll having a crown portion fixedly attached to said roll to provide the bow.

14. The apparatus of claim 11, wherein said backing support is a photoreceptor channel backer, bowed into a center portion of the belt-type photoreceptor and disposed adjacent to and opposite said cleaning blade with U-arms of said channel backer being respectively disposed upstream and downstream of said cleaning blade.

15. The apparatus of claim 11, wherein said bowed backing support defines an arc having a radius of curvature in the range of 100–300 feet.

16. The apparatus of claim 14, wherein said channel backer further comprises a channel stiffener bar fixedly attached to said channel backer to prevent backer deflection.

* * * * *